United States Patent [19]

Birke et al.

[11] Patent Number: 5,060,362

[45] Date of Patent: Oct. 29, 1991

[54] SLUG RIVETING METHOD AND APPARATUS WITH C-FRAME DEFLECTION COMPENSATION

[75] Inventors: James L. Birke, North Tonawanda; David Michalewski, Buffalo; Steven Gross, Lancaster; Robert J. Kellner, Orchard Park; Mark J. Andrews, Niagara Falls, all of N.Y.

[73] Assignee: Gemcor Engineering Corp., Buffalo, N.Y.

[21] Appl. No.: 550,514

[22] Filed: Jul. 10, 1990

[51] Int. Cl.[5] ..... B23P 19/04; B27C 3/06

[52] U.S. Cl. ..... 29/525.2; 29/34 B; 29/243.53; 29/509

[58] Field of Search ..... 29/509, 243.54, 243.55, 29/243.56, 34 B, 525.1, 525.2, 243.53; 72/386, 391, 396, 416

[56] References Cited

U.S. PATENT DOCUMENTS

| | | | |
|---|---|---|---|
| 3,874,070 | 4/1975 | Falcioni | 29/509 X |
| 4,192,058 | 3/1980 | Falcioni | 29/525.2 |
| 4,864,713 | 9/1989 | Roberts et al. | 29/243.54 X |
| 4,908,928 | 3/1990 | Mazurik et al. | 29/525.1 |

*Primary Examiner*—Joseph M. Gorski
*Assistant Examiner*—Peter Dungba Vo
*Attorney, Agent, or Firm*—Hodgson, Russ, Andrews, Woods & Goodyear

[57] ABSTRACT

A method and apparatus for riveting two workpieces (20, 22) together by simultaneously upsetting both ends of a slug rivet (12). The present apparatus includes a frame portion (44) which may deflect during the rivet upsetting operation and a frame compensation booster assembly (164) which is provided to ensure that movement of the upper riveting ram relative to the frame portion (44) is increased an amount equal to the frame deflection so that the workpieces will be maintained in a substantially fixed work plane during the upsetting operation. Before the slug rivet is upset and after the slug rivet has been snugly engaged by the riveting rams (50, 60) the pressure behind the riveting rams is equalized by introducing fluid into the cylinder (48) until the pressure within the cylinder (48) equals the pressure within the cylinder (56). This is to prevent movement of the workpiece at the commencement of the upsetting operation.

10 Claims, 5 Drawing Sheets

FIG. 11
OPERATION FUNCTION TABLE
SOLENOID VALVE LABELS AND OPERATION

| FUNCTION | STEP | H5 | H6 | 90 | HA27 | HB27 | H32 | H45 | 86 | H66 | H67 | P71 | H72 | H75 | H77 | P87 | FUNCTION END DEVICE |
|---|---|---|---|---|---|---|---|---|---|---|---|---|---|---|---|---|---|
| EXTEND PRESSURE FOOT | 1 | 0 | 0 | U | 0 | 0 | 0 | 0 | R | 0 | 0 | 0 | 0 | 0 | 0 | 0 | 98 |
| CLAMP WORKPIECE | 2 | 0 | 0 | U | 0 | 0 | 0 | 0 | R | PB | 0 | 0 | 0 | 0 | 0 | 0 | 100 |
| DRILL WORKPIECE | 3 | 0 | 0 | D | 0 | 0 | 0 | 0 | R | 0 | 0 | 0 | 0 | 0 | 0 | 0 | 104 |
| RETRACT DRILL | 4 | 0 | 0 | U | 0 | 0 | 0 | 0 | R | 0 | 0 | 0 | 0 | 0 | 0 | 0 | 106 |
| TRANS UPR HD TO BUCK | 5 | 0 | 0 | U | 0 | 0 | 0 | 0 | L | 0 | 0 | 0 | 0 | 0 | 0 | 0 | 108 |
| EXT BUCK DWN LIMITER | 6 | 0 | 0 | U | 0 | 0 | 0 | 0 | L | 0 | 0 | 0 | 0 | 0 | 0 | PB | 116 |
| BUCK DOWN | 7 | 0 | 0 | U | PA | 0 | 0 | 0 | L | 0 | 0 | 0 | 0 | 0 | 0 | PB | 118 |
| EXT UPR CAV DPTH STOP | 8 | 0 | 0 | U | 0 | 0 | 0 | 0 | L | 0 | 0 | PB | 0 | 0 | 0 | PB | 114 |
| SET UPPER CAVITY AND RETRACT DOWN LIMITER | 9 | 0 | 0 | U | 0 | PB | 0 | 0 | L | 0 | 0 | PB | 0 | 0 | 0 | 0 | TIMER & 128 |
| PERFORM SNUG OPERATION | 10 | 0 | 0 | U | 0 | 0 | 0 | 0 | L | PB | IO | PB | 0 | 0 | PA | 0 | 70 |
| PREPRESSUREIZE BUCK AND RETRACT CAV DPTH STOP | 11 | 0 | 0 | U | 0 | 0 | IO | PB | L | 0 | 0 | 0 | 0 | 0 | PA | 0 | 134 |
| SQUEEZE - SQUEEZE FORM SLUG ESTABLISH FLOW PATHS | 12 | 0 | 0 | U | 0 | 0 | IO | 0 | L | O | 0 | 0 | 0 | 0 | PA | 0 | |
| FORM SLUG | 13 | 0 | 0 | U | 0 | 0 | IO | 0 | L | O | 0 | 0 | PA | IO | PA | 0 | 70 |
| DECOMPRESS C FRAME | 14 | 0 | AT | U | 0 | 0 | 0 | 0 | L | PA | OI | 0 | 0 | 0 | AT | 0 | 168 |
| RETRACT DUAL BOOSTER | 15 | P | AT | U | 0 | PB | 0 | 0 | L | PA | 0 | 0 | AT | 0 | 0 | 0 | 170 |
| UNCLAMP | 16 | P | AT | U | 0 | PB | 0 | 0 | L | PA | OI | 0 | 0 | 0 | 0 | 0 | 174 + 172 |
| TRANS TO DRILL POS. | 17 | P | 0 | U | 0 | 0 | 0 | 0 | R | 0 | 0 | 0 | 0 | 0 | 0 | 0 | 108 |
| RETRACT UPPER BUSHING | 18 | P | AT | U | 0 | 0 | 0 | 0 | L | PA | IO | 0 | 0 | 0 | AT | 0 | 166 |

SLUG RIVETING METHOD AND APPARATUS WITH C-FRAME DEFLECTION COMPENSATION

TECHNICAL FIELD

The present invention relates generally to a riveting method and apparatus, and more particularly to a method and apparatus for riveting two or more workpieces together wherein both ends of a slug are simulataneously upset during riveting, the workpieces being maintained at a substantially constant level during riveting, and wherein the tooling used for upsetting the slug is supported by a C-frame, the method and apparatus accommodating the C-frame deflection which may occur if the C-frame is supported at a location other than its midpoint.

BACKGROUND OF THE INVENTION

In the aircraft industry various components of an aircraft wing are riveted together by slug rivets. A slug rivet is a rivet formed from a slug that does not have a preformed head and which has both ends deformed during riveting. Because of the large number of rivets utilized to produce a single aircraft wing, and also because of the requirements of the virtually indefinite life of the rivets, much attention has been given in the industry to various methods and apparatus for riveting. One riveting method and apparatus which has recently been proposed is shown in U.S. Pat. No. 4,908,928. When practicing the method and apparatus disclosed in the aforementioned patent the upper and lower riveting rams are mounted by cylinder assemblies in a generally C-shaped frame such as that shown schematically in FIG. 1 of U.S. Pat. No. 4,864,713. According to the method and apparatus U.S. Pat. No. 4,908,928 after the upper and lower riveting rams have been snugged against the rivet, which has previously been inserted into aligned apertures in the workpieces, fluid is simultaneously introduced in the cylinders behind each of the upper and lower riveting rams to cause the riveting rams to move together at substantially the same with respect to the cylinder. As the upper and lower riveting rams are moving at the same rate with respect to the cylinder there is little movement of the workpiece during riveting. In other words, the workpieces will not move, or will barely move, relative to a fixed work plane. Movement of the workpieces with respect to a fixed work plane is known in the industry as a "wink". If the workpieces are winked or moved during the squeeze cycle of a riveting process they will have a tendency to oscillate before returning to their original position. This oscillation could delay the next rivet forming operation or any other subsequent operation. If there is limited movement of the workpieces during riveting even greater uniformity of the bulging of the rivet may be achieved which is desirable for rivet fatigue life cycles. The limited movement of the workpiece during slug forming permits clamping the workpiece into a rigid fixture which guarantees the accuracy of the workpiece geometry. Since it is not required that the riveter tooling lift the workpiece to cause wink, there is a reduced chance that the tooling will mar the surface of the workpiece.

When using the machine of U.S. Pat. No. 4,908,928 many of the foregoing objectives have been achieved. However, the foregoing machine includes a midpoint supported C-frame which can be shifted vertically, and which can also be rocked and tilted so that the riveting rams may be positioned perpendicular to the surface of the upper workpiece which is held in a stationary manner. However, in some instances, it is desirable to support the wing for vertical and tilting movements while supporting the riveting rams only for X and Y movements in the horizontal plane. When this form of apparatus is utilized the riveting rams are supported on a large C-shaped frame which is supported at a lower portion of the C-shaped frame. Accordingly, it can be appreciated that when using this form of device that as the upper riveting ram moves downwardly against a rivet which is simultaneously being squeezed by a lower riveting ram that the upper frame may deflect slightly, for example 50/1000 of an inch. In some applications this much movement is undesirable and therefore it is desirable that a method and apparatus be developed which will compensate for frame deflection.

It has also been found in the design shown in U.S. Pat. No. 4,908,928 that when the upper and lower rams have been brought into snug engagement with a slug rivet at the commencement of the slug upsetting operation that the pressures bearing upon the pistons for the upper and lower riveting rams are not equal but that, in fact, the pressure on the lower ram is greater than the upper ram. At the commencement of the upsetting operation therefore there is a slight tendency for the upper ram to be deflected upwardly and it is desirable that this be avoided.

OBJECTS AND SUMMARY OF THE INVENTION

It is an object of the present invention to provide a method and apparatus for riveting two or more workpieces together by a slug wherein both ends of the slug are simultaneously upset during riveting, the riveting rams being carried by frame portions which deflect unequally during riveting and wherein there is compensation for frame deflection during riveting so that the workpieces are maintained at a substantially constant level and there are substantially even rates of movement with respect to the workpiece by the upper and lower riveting rams.

It is a further object of the present invention to provide a method and apparatus for riveting two or more workpieces together wherein a slug, inserted into the workpieces, is initially snugly engaged by upper and lower riveting rams, the upper riveting ram being held against a stop to establish a die cavity, and the lower riveting ram being brought into engagement with the slug rivet to force it against the upper riveting ram wherein the pressures on the pistons for the upper and lower riveting rams are equalized after initial snug engagement and prior to the commencement of the slug upsetting operation.

The foregoing objects and other objects and advantages of this invention will become more apparent from a consideration of the following detailed description taken in conjunction with the accompanying drawings in which a preferred form of this invention is illustrated.

BRIEF DESCRIPTION OF THE DRAWINGS

FIG. 11 is an operational function table illustrating the position of the various valves shown in FIGS. 10*a* and 10*b* at the completion of each of the operational steps of this invention, which operational steps are set forth below, the table further indicating the feedback mechanism for the control of the completion of each step.

DETAILED DESCRIPTION

Figure 1:
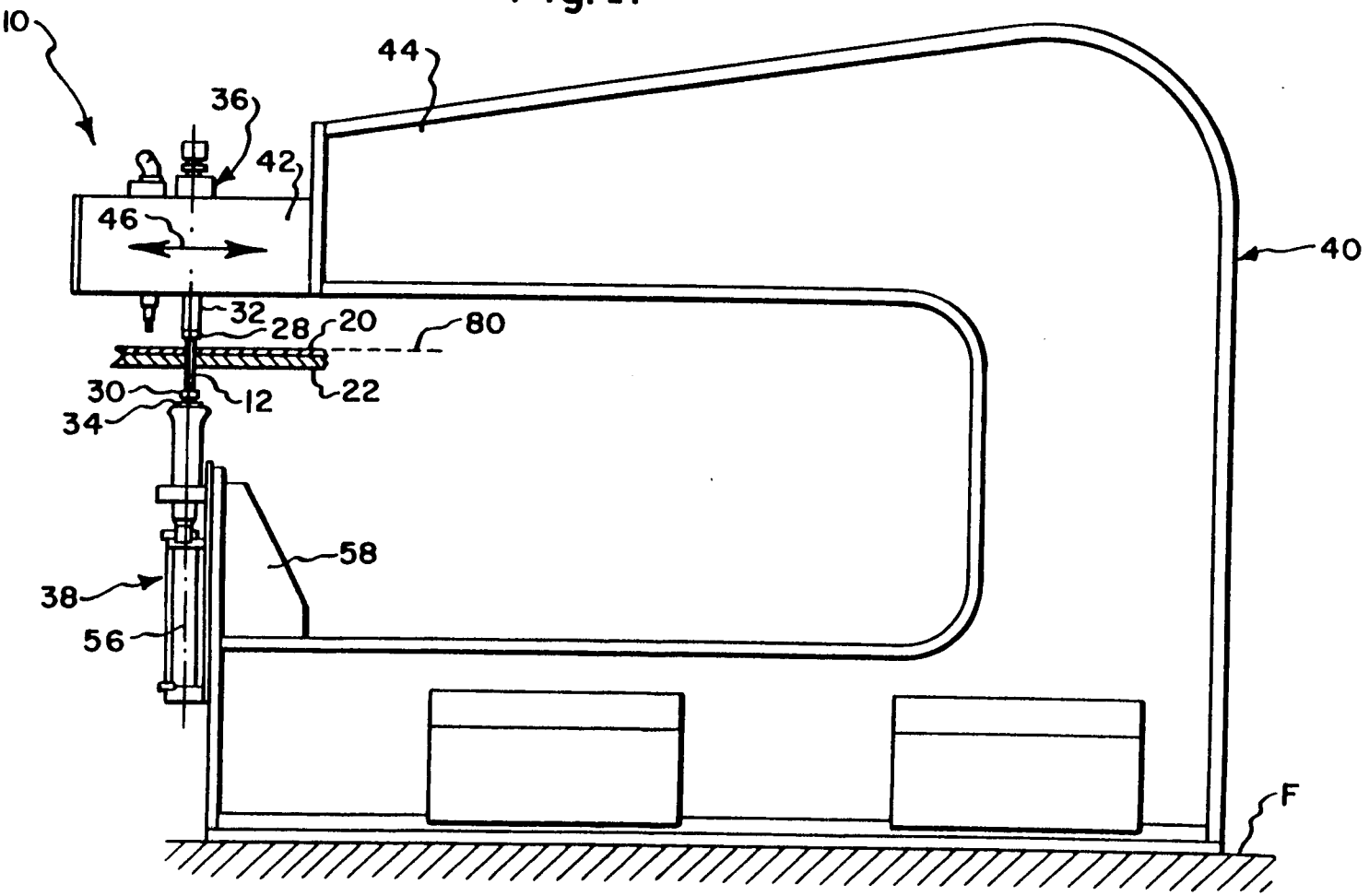
FIG. 1 is a side elevational somewhat schematic illustration of the apparatus in which the principles of the present invention have been incorporated.
Figure 10A:
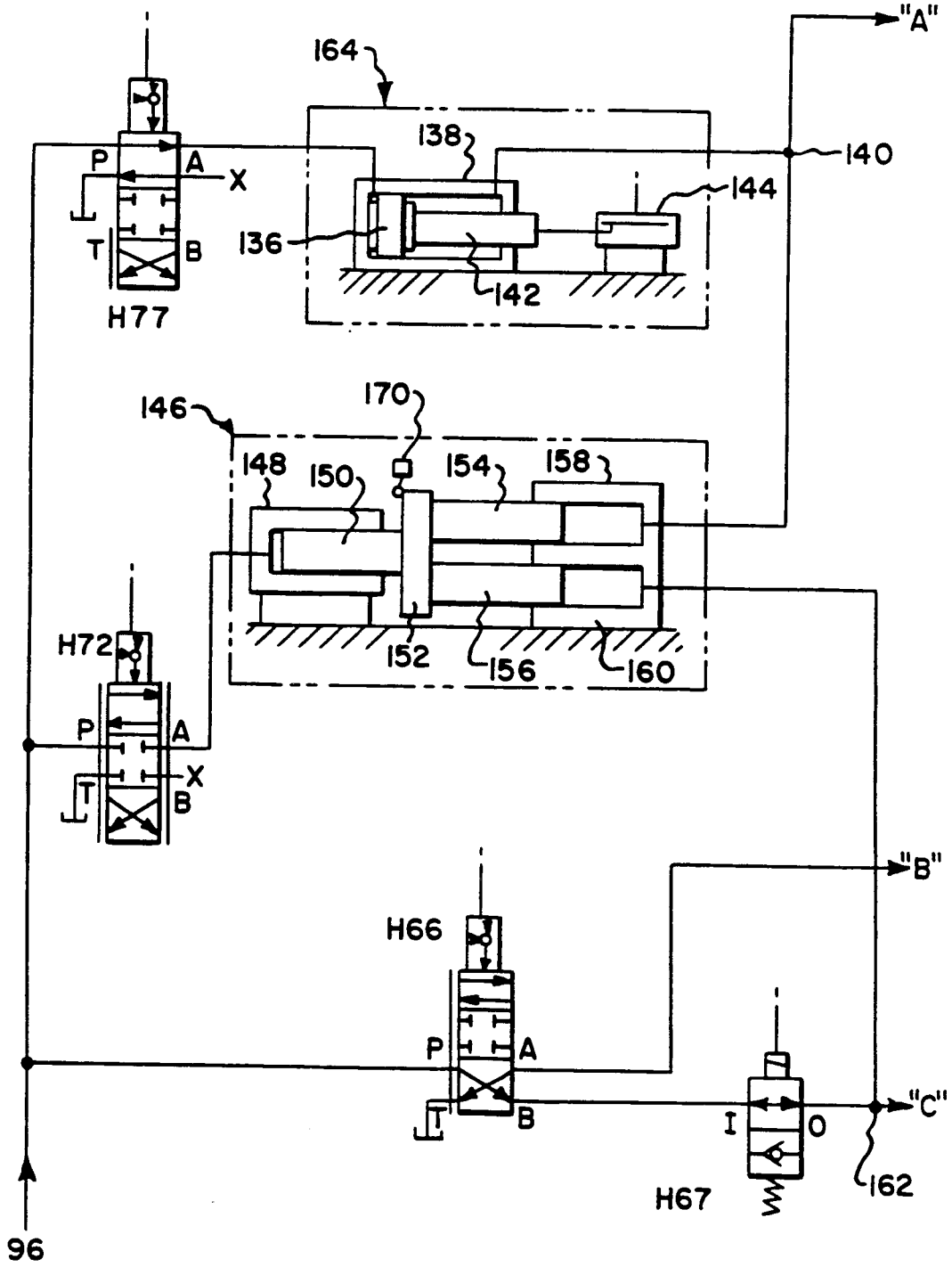
FIGS. 10*a* and 10*b* are a schematic illustration of a portion of the apparatus of this invention showing tooling and clamps carried by the frame and various control devices, the apparatus and the various control devices being shown in the position which they will occupy at the completion of step 10 below.
Figure 10B:
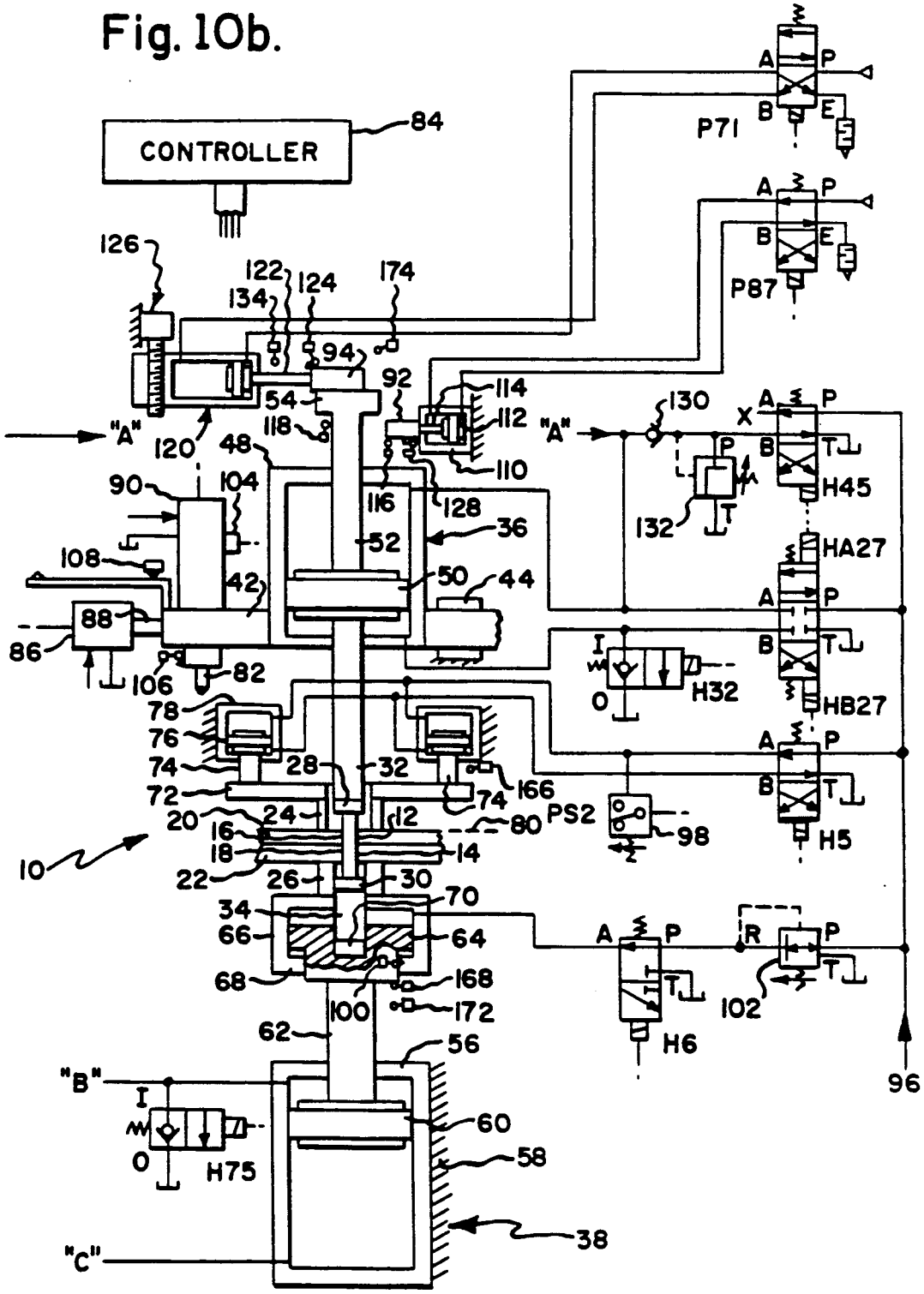

Referring first to FIG. 1 the riveting apparatus of this invention is indicated generally at 10, the apparatus being for the purpose of securing together two or more workpieces by a slug 12 which is to be formed into a rivet 14 (FIG. 8), the slug being initially inserted in a conventional manner between aligned apertures 16 and 18 (FIG. 3) in workpieces 20 and 22, respectively. While only two workpieces 20 and 22 are shown in the various figures, it should be appreciated that more than two workpieces can be secured together. During the riveting operation the workpieces are held together by clamps or bushings in the form of an upper pressure foot bushing 24 (FIG. 2, not shown in FIG. 1) and a lower pressure foot or clamp bushing 26. Immediately before the slug 12 is to be deformed into the rivet 14 it is engaged by an upper head forming button 28 and a lower head forming button 30, the upper and lower buttons being carried in turn by upper and lower riveting rams or anvils 32, 34, respectively. The anvils 32 and 34 are interconnected with upper and lower hydraulic cylinder assemblies indicated generally at 36 and 38, respectively, which cylinder assemblies are in turn supported by spaced apart portions of a C-frame indicated generally at 40. A subframe 42 is carried by an upper portion 44 of the C-frame for fore and aft movement in the direction indicated by arrow 46 in FIG. 1. The upper hydraulic cylinder assembly 36 is in turn mounted on the subframe 42 and to this end an upper ram cylinder body 48 is rigidly secured to the subframe 42 as schematically illustrated in FIG. 10*b*. Mounted within the cylinder body 48 is an upper ram piston 50. The upper riveting ram 32, which is in the form of a piston rod, is secured to the lower end of the piston 50 and extends through a suitable aperture in the cylinder body 48. An upper ram rod extension 52 extends above the piston 50 and through a suitable aperture in the upper end of the cylinder body 48, the upper ram rod extension 52 being provided with an upper ram down limiter stop catch 54, the function of which will be explained later.

The lower hydraulic cylinder assembly 38 includes a lower ram cylinder body 56 which is rigidly secured to a lower portion 58 of the C-frame 40. Mounted within the cylinder body 56 is a lower ram piston 60. Extending upwardly from the lower ram piston 60 is a lower ram piston rod 62. The upper end of the rod 62 has a lower clamp piston 64 mounted thereon. A lower workpiece clamp cylinder 66 is supported by the piston 64 for vertical shifting movement and to this end the cylinder 66 has a flange 68 which may abut against the lower surface of the piston 64. As can be seen from FIG. 10*b* the lower pressure foot bushing 26 is carried by the upper end of the lower workpiece clamp cylinder 66, the bushing 26 being slidably disposed about the lower riveting ram 34 and lower head forming button 30. The lower riveting ram 34 is also mounted within a aperture in piston 64, the aperture having a centerline concentric with the centerline of the piston 64 and cylinder 66. Disposed between the lower riveting ram 34 and the piston 64 is a force load cell 70.

The upper pressure foot bushing 24 (which cooperates with the lower pressure foot bushing 26 to clamp the workpieces 20 and 22) is supported on an upper pressure foot plate 72. The plate 72 is secured to pressure foot cylinder rods 74 which are, in turn, secured to the lower end of pressure foot pistons 76 disposed within pressure foot cylinders 78. The pressure foot cylinders 78 are secured to an upper portion 44 of the C-shaped frame 40 in a conventional manner not material to the present invention.

The method and apparatus of this invention has been designed to be used with workpieces 20 and 22 which are supported for vertical movement as well as various other degrees of movement by workholders (not shown) which are of a type well known in the art. Thus, it is possible to vertically shift the workpieces and to properly angle them so that the upper surface of the upper workpiece at the location when a rivet is to be formed lies in a predetermined reference plane spaced above but parallel to the support of the apparatus of the invention. Accordingly, the C-frame 40 is supported for movement only in a horizontal plane parallel to the surface of the floor F so that a desired work plane 80 is established, the disposition of the workpieces being controlled by suitable position sensors. The upper surface of the upper workpiece is clamped into the work plane by bringing down the upper pressure foot bushing 20, the lower surface of which will lie in the work plane, and then by clamping the workpiece against this bushing. This will be brought out below in greater detail.

Additional components of the apparatus will be discussed in connection with the following detailed description of the operation of the apparatus of the present invention.

OPERATION

Initial Position

Initially, or at the completion of the last riveting operation, the workpieces 20 and 22 are brought to their desired position by the workpiece supporting apparatus, not shown, by vertically shifting or tilting the workpieces. When in the desired position the location of the upper surface of the upper workpiece which is to be riveted will lie in reference plane 80. In addition, the riveting frame 40 will have been shifted to its next riveting position by moving the frame 40 in X and Y directions, and the riveting apparatus will have been placed in its initial position. When the riveting apparatus supported by the frame 40 is in its initial position the subframe 42 will be in its right-hand position to place a drill bit 82 in a position where it is in concentric alignment with the upper and lower bushings 24, 26. To this end the subframe 42 is caused to be placed in its proper position by controller 84, the controller causing operation of an upper head transfer cylinder assembly 86 which includes a rod 88 connected directly to the transfer table or subframe 42. Thus, the assembly 86 will have been operated to shift the subframe 42 from the left-hand position, shown in FIGS. 1 and 10, to its right-hand position. The drill bit 82 is in turn connected to a workpiece drill spindle assembly 90 which includes a suitable chuck, rotary motor, and vertical transfer device for moving the drill bit upwardly and downwardly as it is being rotated. The motors for imparting both rotary and vertical motion are both under the control of controller 84. Initially, the drill 82 will be in its drill up position shown in FIG. 10*b*. Similarly, the upper bushing 24 will be in its bushing up position and the lower bushing 26 will be in its bushing down position. The ram down limiting stop 92 (FIG. 10*b*) which is adapted to be contacted by the upper ram down limiter stop catch 54 will be in its retracted position, the position shown in FIG. 10*b*. Similarly, the upper cavity depth control stop 94 will also be in its retracted position, not in its extended position in shown in FIG. 10*b*.

In addition to the apparatus so far described there are a number of differing control valves which include, in addition to the solenoid-operated control valves associated with the transfer cylinder assembly 86 and the drill spindle assembly 90, various hydraulic and pneumatic valves. Hydraulic valves are indicated by an alpha-numeric designation beginning with the letter "H" and air valves by an alpha-numeric designation beginning with the letter "P". In addition to the various control valves, other hydraulic function devices are provided, such as pressure control valves. These various valves and devices will be identified below in the description of the operation.

When the machine is initially positioned the various valves utilized in the control of the function of the machine will be in the various positions shown in the operation function table (FIG. 11) at the completion of step 18. In addition, the workpiece will be properly mounted within the C-frame so that the upper and lower bushings 24 and 26 are co-axially aligned with that position where a slug 12 is to be inserted and formed into a rivet, the upper surface of the upper workpiece at the rivet location being in the reference plane 80, or very close to it.

Step 1—Extend Upper Pressure Foot Bushing

Solenoid valve H5, which is disposed between a source of hydraulic fluid under pressure (indicated by fluid pressure line 96) and the pressure foot cylinders 78, is turned from its on position to its off position, indicated by the letter "O" in the function table. When this happens a flowpath will be established between pressure port P and auxiliary port A, and also between auxiliary port B and discharge or tank port T. Therefore, fluid will be directed to from fluid line 96 to the anchor end of the pressure foot cylinders 78 causing the pistons 76 and rods 74 to move downwardly extending the upper pressure foot bushing 21 to its down or stop position, the lower surface of the upper pressure foot bushing then lying in the work plane 80. After the pistons 76 have bottomed out in their respective cylinders 78 the fluid pressure will build up in the fluid line from port A of valve H5 to cylinders 78 until pressure switch 98 actuates. The actuation of pressure switch 98 will be transmitted back to the controller 84, which will in turn cause the controller to initiate the next operational step.

Step 2—Clamp Workpieces

Figures 2, 3, 4, 5, 6, 7, 8, 9:
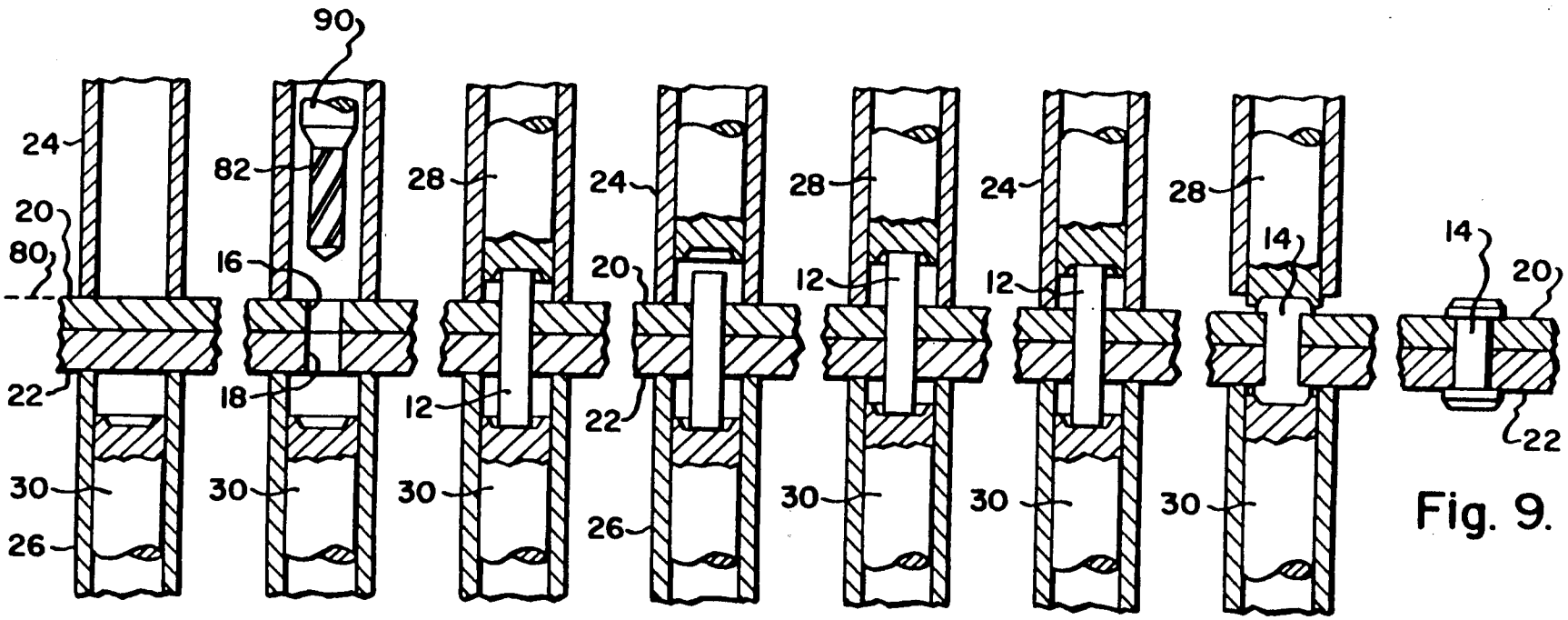
FIGS. 2 through 9 illustrate a sequence of operational steps utilized in the performance of the method of this invention.

When the controller 84 receives the signal from pressure switch 98 that the upper pressure foot bushing 24 is in its lower position it will cause servo valve H66 to shift from its off position "O" to an on position where pressure port P is connected to port B and similarly port A is connected to tank port T. The resulting fluid flow from the fluid pressure line 96 will cause the lower ram piston 60 to extend upwardly carrying with it the lower workpiece clamp cylinder 66 and lower pressure foot bushing 26. Continued upward movement will cause the lower bushing 26 to engage the lower surface of the lower workpiece 22 and to force the workpieces 22 and 20 into tight engagement with each other and also with the upper pressure foot bushing 24. When this occurs continued upward movement of piston 60 will cause the lower clamp piston 64 to move upwardly with respect to the lower workpiece clamp cylinder 66 until limit switch 100 is actuated. As the cylinder 66 is collapsing with respect to piston 64 fluid will be forced from the cylinder 66 to reservoir through valve H6 and control valve 102 as there is reverse flow from port A through pressure port P in valve H6 and then through the pressure control valve 102 as there is flow from port R to tank port T. The completion of this step is shown in FIG. 2.

Step 3—Drill Workpieces

When the limit switch 100 is actuated at the completion of step 2 the controller 84, which receives feedback signal from switch 100, will then cause the servo valve H66 to be shifted back to its off or blocking position, the off position being indicated by the letter "O" in the function table. At this time the operation of the drill spindle assembly will be initiated causing the drill bit 82 to be rotated and to be moved in a downwardly direction to drill aligned apertures 16 and 18 in workpieces 20 and 22. This step when completed will be sensed by the drill down pressure switch 104.

Step 4—Retract Drill

When the controller 84 receives a signal from the drill down pressure switch 104 that the drilling has been completed it will send a signal to the drill spindle assembly 90 to retreat the drill to its fully retracted position and also to stop rotation of the drill bit 82. This step is illustrated at FIG. 3. The full drill up position will be sensed by limit switch 106.

Step 5—Transfer Subframe to Buck Position

When the controller 84 receives a signal from limit switch 106 it will then cause operation of the transfer cylinder assembly 86 which will move the upper head or subframe 42 to the left until the buck cylinder or upper ram cylinder body 48 is centered over the drilled hole as shown in FIGS. 1 and 10*b*. Arrival at this position is sensed by the upper head position feedback device 108.

Step 6—Extend Upper Ram Down Limiting Stop

Once the feedback device 108 has indicated that the subframe 42 has attained its desired operational position for further steps the controller 84 will send a signal to solenoid valve P87 to open flowpaths from pressure port P to port B and from port A to tank port T. The resulting air flow will cause the upper ram down limiting stop 92 to be extended to the left as air is introduced into the right-side of air cylinder 110 causing piston 112 and piston rod 114 to be shifted to the left, stop 92 being carried by rod 114. When the stop 92 is fully extended to its stop position the limit switch 116 will be contacted.

Step 7—Insert Slug

When the controller 84 receives the signal from limit switch 116 it will initiate operation of solenoid HA27 in the valve H27 to open the flowpath from pressure port P to port A and from port B to tank port T. The resulting fluid flow will cause the buck ram piston 50 and the rod or ram 32 as well as extension 52 to be shifted downwardly as fluid flows into the chamber above the piston 50. A slug 12, which was previously loaded into the buck ram tooling, is caused to be inserted into the aperture 16 and 18 drilled in workpieces 20 and 24 as the ram 32 and button 28 are moved downwardly. The buck ram will continue to move downwardly until the upper ram down limiter stop catch 54 contacts the down limiter stop block 92. This will cause the movement of the buck ram 32 to be limited and will actuate the buck down limit switch 118. The completion of this step is illustrated in FIG. 4.

Step 8—Extend Upper Cavity Depth Control Stop

When the controller 84 receives a signal from limit switch 118 it will cause the solenoid HA27 to be shifted to its off position returning valve H27 to its central blocked position illustrated in FIG. 10*b*. At the same time the controller will also cause operation of solenoid valve 71 which will open flowpaths from pressure port P to the B port and from the A port to the exhaust port E. The resulting air flow will cause extension of the depth control cylinder assembly 120 to the right, the cylinder assembly including a rod 122 on which is mounted the upper cavity depth control stop 94. When the stop 94 is moved to its full right-hand position the limit switch 124 will be contacted. It should be noted that it may be desired to vertically adjust the position of the stop 94, and the vertical adjustment may be achieved in any manner such as for example a screw assembly schematically illustrated at 126.

Step 9—Set Upper Cavity

Actuation of limit switch 124 will cause the controller 84 to operate solenoid HB27 which will open the flowpaths from the pressure port P to port B and also from port A to tank port T. At the same time the operation of a delay timer will be initiated, the delay timer being at any suitable location. At the same time that the operation of the solenoid HB27 is switched on the controller will also shift valve P87 to its off position. The resulting fluid flow through valve H27 will cause the buck ram assembly 28, 32, 50, 52 to initially retract upwardly to separate catch 54 from stop 92. When this occurs down limiter stop 92 will move to its right-hand position shown in FIG. 10*b*. When the stop 92 attains the right-hand position a limit switch 128 will be, and the ram assembly will continue to move upwardly until the upper surface of the stop or catch 54 contacts the stop 94 halting further ram movement. The timer is so set that it will time out shortly after the stop block has been contacted. The completion of this step is shown in FIG. 5.

Step 10—Perform Snug Operation

Step 10 is initiated when limit switch 128 is actuated and when the timer times out. When these events occur the solenoid HB27 will be shifted back to its off position, and the controller will also turn on the solenoid valve H66 to initiate a flow of fluid from pressure port P to B and also from port A to tank port T, the resulting fluid flow causing piston 60 to extend upwardly pushing the slug 12 up against the buck ram button 28 creating a snug force which is sensed by load cell 70. Using the feedback from the load cell 70 the servo valve H66 is modulated so that the snug force is maintained on the slug 12. At the same time that the operation of valve H66 is initiated, valve H67 will be shifted from the off position to the on position so fluid may flow freely from the input port I to the output port O. The servo valve H77 is caused to commence operation at this point. This operation will be described below in step 12. However step 12 is performed concurrently with the operation of steps 10, 11, and 13. Step 10 will be completed when a full snug force is sensed by the load cell 70. The completion of this step is illustrated in FIGS. 6, 10*a* and 10*b*.

Step 11—Equalize Ram Pressures and Retract Cavity Depth Stop

During this step the chamber above buck ram piston 50 is pressurized so that it will be at the same pressure as the chamber below the lower ram piston 60. The purpose of this novel step is to ensure equal rates of movement of the upper and lower riveting rams of the commencement of the riveting operation, step 13 below. This step is commenced when the controller 84 receives a signal from the load cell 70 to the effect that full snug force has been achieved, the controller then causing P71, H66, and H67 to shift to their off positions, and valves H32 and H45 to shift to their on positions. When P71 is shifted to its off position the pressure port P is connected with port A and the B port is connected with the exhaust port E. This will permit the stop 94 to retract (by moving to the left in FIG. 10*b*) as soon as the pressure exerted on the stop 94 by catch 54 is reduced, which pressure is at right angles to the movement of the stop. At the same time that valve P71 is switched to its off position the actuation of valves H66 and H67 will stop the introduction of fluid behind the lower piston 60 and actuation of valves H32 and H45 will initiate introduction of fluid behind the upper piston 50 until the forces on pistons 60 and 50 are equalized. Thus, when valve H66 is switched to its off position and valve H67 is also switched to its off position fluid behind or below the piston 60 will be trapped within the cylinder 56. At the same time when valve H32 is switched to its on position a flowpath is opened between the inlet and outlet ports I and O, and when valve H45 is switched to its on position fluid will flow through valve H45 from pressure port P through auxiliary port B, the flow through the valve then passing through check valve 130 and from there to the cylinder 48 to cause fluid to be introduced behind the piston 50. The resulting fluid flow will cause the upper chamber of the buck cylinder 48 to be pressurized to a pressure determined by the operation of a pressure control valve 132 which is disposed in the fluid line between the valve H45 and the check valve 130. When the prepressurization operation of the buck ram is complete and the force caused by the snug operation between the stop 94 and the catch 54 is relieved the cylinder assembly 120 will be retracted and the stop 94 will actuate limit switch 134. The completion of this step is shown in FIG. 7, and it can be seen that the buttons 28 and 30 are moved down a small amount as the pressures are equalized.

Step 12—Frame Deflection Compensation

It is a feature of this invention that there is compensation for frame deflection during the rivet forming operation. However, since there may be a small amount of frame deflection prior to the actual upsetting of the slug, for example, during the snug operation set forth in step 10, the frame deflection compensation procedure is initiated with step 10 and is done concurrently with steps 10, 11, and the upsetting operation set forth in step 13. Thus, as indicated above in the discussion of step 10 the compensation sequence is initiated by causing the servo valve H77 to shift from a blocked position to a position where pressure port P is placed in communication with port A as illustrated in FIG. 10*a*. As the valve H77 is a servo valve the flow through the passageway from port P to A may be modulated by an input signal which is under the control of controller 84. Whenever force is applied to the rivet 12, either during the rivet snug step set forth above at 10 or during the rivet forming step set forth below in step 13, the load cell 70 will sense it and send an electrical signal proportionate to the force being applied to the controller 84. This signal is compared to a force verses C-frame deflection ratio which has been programmed into the riveter controller 84 and, from this, a command signal is generated which is transmitted to the servo valve H77 during steps 10 through 13. The modulated flow from port P to port A will cause fluid to be introduced behind piston 136 within the auxiliary booster cylinder 138. As the piston 136 moves to the right, as viewed in FIG. 10*a*, fluid will flow from the rod side of the cylinder 138 through outlet O to T-junction 140. During step 10 this will cause fluid flow to the upper end of the buck ram cylinder 48 to cause the buck ram piston 50 to move downwardly with respect to the cylinder. However, the movement of the piston 50 downwardly with respect to the cylinder 48 caused by the introduction of fluid from the booster cylinder 138 is programmed to be directly proportional to the upward movement of the cylinder 48 caused by the elastic deflection of the C-frame portions 42, 44. As the piston 136 moves to the right it will also move the associated piston rod 142 in the same direction. Associated with the rod is a linear transducer 144. Thus, as the piston 136 is being moved to the right to displace fluid from the booster cylinder 138 the movement of the piston and the volume of the fluid being displaced can be monitored by the linear transducer 144. The output of the transducer serves as a controlling feedback to the riveter controller 84 to ensure that the stroke length of the piston and piston rod 136, 142 is correct. It should be noted that while the fluid displaced from the cylinder 138 through output port O is directly proportional to the volume of a fluid being introduced into the cylinder 48 during step 10 that it will be supplemental to the volume of fluid added to the cylinder 48 during step 13 as most of the fluid during the upsetting operation comes from the dual booster actuating cylinder body assembly indicated generally at 146, the operation of which will be described below in connection with step 13. This step will be completed with the completion of step 13.

Step 13–Upset Slug

At the completion of step 11, which is sensed by the limit switch 134 when stop 94 retracts, the controller 84 will cause the valve H45 to be shifted to its off position, illustrated in FIG. 10*b* and check valve 130 will prevent reverse flow through the valve from port B to tank port T. At the same time the controller 84 causes the servo valve H72 to be shifted to a position where pressure port P is in modulated communication with port A so that fluid may be discharged to the dual booster assembly indicated generally at 146. The dual booster assembly includes a dual booster actuating cylinder body 148, a dual booster actuating cylinder ram 150, and a cross-member 152 rigidly supported on an outwardly extending portion of the ram 150. The cross-frame member in turn carries parallel upper and lower booster rams 154, 156, respectively. The upper ram 154 extends into an upper cylinder body 158 and the lower ram extends into a lower cylinder body 160. It should be obvious that as, as shown in FIG. 10*a*, fluid is introduced into the cylinder body 148 behind ram 150 that the ram will be moved to the right carrying with it the cross-frame member 152 and the upper and lower booster rams 154 and 156. These rams will be forced into the cylinders 158 and 160 displacing fluid from these cylinders as these cylinders are mounted in common with the cylinder 148 so that there is no relative movement between the cylinders. As fluid is displaced from the upper booster cylinder 158 it will be discharged from the cylinder body 158 through the line which extends to the T-intersection 140. Similarly, as fluid is displaced from the lower booster cylinder body 160 it will be displaced into that fluid line which is interconnected with the T-junction 162 which is in that fluid line which extends between port 0 in valve H67 and the lower end of the lower ram cylinder 56. During the operation of step 13 fluid displaced from the upper booster cylinder body 158 will join that fluid being displaced from the frame compensation booster assembly, indicated generally at 164, at junction 140 to cause fluid to be introduced into the upper buck cylinder 48 behind piston 50. This will cause the buck ram 32 and upper head forming button 28 to be moved downwardly. At the same time this is occurring fluid will also be displaced from the cylinder body 160 causing fluid to be introduced into the lower ram cylinder body 58 which will move the piston 60, lower riveting ram or anvil 34 and lower head forming button 30 upwardly causing the rivet to be upset. Fluid displaced from the chamber in cylinder 56 above piston 60 will be discharged directly to tank through valve H75, this valve being switched from an off position to an on position at the commencement of this step. In accordance with the design criteria set forth in U.S. Pat. No. 4,908,928 the area ratios between the upper and lower booster rams are so proportioned with respect to the areas of the upper and lower pistons 50 and 60 that the upper and lower head forming buttons 28 and 30 move towards each other at equal rates. As the two ram assemblies move towards each other with equal rates while even though there is frame deflection in the C-frame associated with the upper riveting ram the deflection force is constantly monitored by the load cell 70 and its output serves as the controlling feedback necessary for the riveter controller 84 to maintain the upper surface of the workpieces in the work plane 80. The rivet forming operation is completed when the load cell 70 senses the attainment of the full forming force which is programmed into the riveter control 84 at an operator's console (not shown). The completion of this step is illustrated in FIG. 8.

Step 14—-Decompress C-Frame

When the load cell 70 senses that the forming force has been achieved, the controller 84 will cause the following operations to occur. Solenoid valves H75 and H32 will be switched to their off positions illustrated in FIG. 10*b*. Valve H6 will be switched on opening a flowpath from auxiliary port A to tank port T thereby reducing the force exerted by the lower clamp bushing 26 to zero. This will cause the lower head forming button, which is initially locked from movement, to resist all the force imposed by the upper button, the upper bushing having been shifted out of contact with the upper surface of the workpieces as the upper portion 44 of the frame has deflected. Servo valve H77 is switched to its auxiliary port A to tank port T position, flow through the valve being controlled or modulated by load cell 70 and linear transducer in the manner described below. Servo valve H72 is switched to its central blocking position or off position. Solenoid valve H67 is turned on to open the flowpath from port O to port I. (This will permit fluid flow from the lower chamber of the lower ram cylinder 56 to port B of servo valve H66). Servo valve H66 is shifted to a cracked open position where the flowpaths between pressure port P and port A are open small amount, the flowpath also being open from port B to tank port T. As H75 now blocks flow to tank, fluid will slowly flow from pressure line 96 through ports P and A in valve H66 to the cylinder 56 above piston 60, causing it to move slowly downwardly. Fluid will now bleed from the lower chamber of cylinder 56 through the valve H67 and then through ports B and T of valve H66, gradually relieving the pressure on the lower ram 26. This reduction of force is monitored by the load cell 70 and the output from the load cell 70 is processed by controller 84 and is used to cause the servo valve H77 to modulate flow from port A of H77 to tank port T to allow the auxiliary booster ram assembly to retract to the left at a rate proportionate to the rate of reduction to the forming force sensed by load cell 70. Thus, as the frame is permitted to spring back to its original position, the spring force stored within the frame is used to move piston 136 to the left at such a rate that the workpieces 20 and 22 are not winked. As the cylinder 48 is moving downwardly with respect to piston 50, make-up oil to cylinder 48 below piston 30 will be drawn from tank through the check valve in H32. When the frame has completed its "spring back," and ram 142 is fully retracted there will be virtually no forces imposed upon the formed rivet 14 by the upper and lower riveting rams or by bushings. After this portion of step 14 is completed the lower ram continues to move downwardly until limit switch 168 is actuated.

Step 15—Retract Dual Booster Assembly

The upsetting rams 32 and 34 will be retracted after limit switch 168 has been contacted (step 14). Initially this is accomplished by retracting the dual booster assembly 146. Thus, actuation of the limit switch 168 at the completion of step 14 will cause the controller 84 to send a signal to servo valve H72 to cause it to partially open the flowpath from port A to tank port T. At the same time H77 is switched off. Solenoid valve H67 is switched by the controller to its off position to close the flowpath from port O to port I. At the same time solenoid HB27 initiates a flow from pressure line 96 through the flowpath between ports P and B in valve H27 to cause the piston 50 to be shifted upwardly, the oil from the cylinder 48 above piston 50 filling the upper booster cylinder 158, the excess flowing to tank through the flowpath between ports A and T of the valve H27. As the operation of the servo valve H66, which was initiated in step 14, continues during this step the lower ram will continue to be retracted downwardly and fluid will flow out of the lower chamber, that is to say the portion of the cylinder 56 below piston 60, this fluid being directed to the lower booster cylinder body 160 which will force the dual booster ram assembly 154, 156 to retract to the left until the limit switch 170 is actuated.

Step 16—Continue to Retract Rams

Actuation of limit switch 170 will send a signal to controller 84 which will in turn send a signal to servo valve H72 shifting it to a centered blocking position. Solenoid valve H67 will also be switched to the on position so that fluid can flow from the chamber in cylinder 56 below piston 60 through the flowpath from the O port to the I port in valve H67 and then through the flowpath from the B port to the tank port T in valve H66, which valve will also be shifted from its partially open position of step 14 to a fully open position. This will permit the lower ram to continue to be shifted downwardly until limit switch 172 is contacted. The buck ram assembly will continue to retract upwardly until the limit switch 174 is contacted by the catch 54. The completion of this step is illustrated by FIG. 9.

Step 17—Transfer to Drill Position

When the limit switch 174 is contacted the controller will cause the valve HB27 to be shifted back to its off position cancelling further upward movement of the buck ram assembly. Actuation of limit switch 172 will cause the controller 84 to switch valve H67 to its off position and the servo valve H66 back to its blocking position, causing the piston 60 ram 34 and lower bushing 26 to be held in a lowered position.

When both limit switches 172 and 174 have been contacted the controller will cause valve H6 to be shifted back to its off position resulting in the repressurization of the lower workpiece clamp which has been moved to a position spaced away from the lower surface of the lower workpiece 22. Also at the same time the controller 84 will initiate operation of the transfer cylinder assembly 86 to shift the subframe from its left-hand position shown in FIG. 10*b* to its right-hand position to place drill spindle assembly 90 in concentric alignment with the cylinders 56 and 48. The attainment of the drill position will be sensed by the upper head position feedback device 108.

Step 18—Retract Upper Bushing

When the feedback device 108 initiates a signal to controller 84, the upper clamp bushing 24 will be retracted by turning valve H5 to its open position causing flow from pressure line 96 through ports P and B to the lower end of pressure foot cylinders 78 below the pressure foot pistons 76, causing the pistons 76, piston rods 74, upper pressure foot plate 72 and upper pressure foot bushing 24 to be moved upwardly to the fully retracted position. The attainment of the retracted position will be sensed by limit switch 166. When a signal has been received by the controller 84 from limit switch 166 it will know that the riveting apparatus may be shifted to its next location prior to initiation of the next riveting operation.

It can be seen from the above that the objects of this invention may be accomplished by prepressurizing the buck ram piston prior to the initiation of the rivet upsetting operation, and also by compensating for frame deflection through the frame compensation booster assembly 164. Thus, it is possible to achieve greater stability of workpieces when riveting in a C-frame of the type illustrated in FIG. 1 that has been known in the prior art.

While a preferred structure in which the principles of the present invention have been incorporated is shown schematically in the accompanying drawings and is described above in detail, it is to be understood that this invention is not to be limited to the particular details, shown and described above, but that, in fact, widely differing means may be employed in the practice of the broader aspects of this invention.

What is claimed is:

1. A method for riveting two or more side-by-side workpieces together with opposed upper and lower riveting ram assemblies, the workpieces being provided with aligned apertures in which a slug rivet has been inserted; comprising the following steps:

positioning the upper riveting ram assembly against an upward movement limiting stop to establish an upper die cavity;

applying an upward force to move the lower riveting ram assembly upwardly towards the upper riveting ram assembly until both ends of the slug rivet are snugly engaged between adjacent ends of the upper and the lower riveting ram assemblies;

applying a downward force to the upper riveting ram assembly after both ends of the slug rivet are snugly engaged until the after both ends of the slug rivet are snugly engaged until the downward force of the upper riveting ram assembly equals the upward force applied to the lower riveting ram assembly, without any deformation of the rivet occuring due to the equal forces; and then;

simultaneously moving the upper and lower ram assemblies towards each other to simultaneously form upset heads on both ends of the rivet, thereby compensating for deflection of a frame carrying said upper and lower ram assemblies.

2. A method for riveting two or more side-by-side workpieces together, the workpieces being provided with aligned apertures in which a slug rivet has been received; said method comprising the following steps:

providing first and second movable riveting ram assemblies, a frame assembly having first and second frame portions, the first and second movable riveting ram assemblies being carried by the first and second frame portions, respectively, and the first frame portion deflecting during a rivet upsetting operation;

snugly engaging the ends of a rivet with adjacent ends of the first and second riveting ram assemblies; and simultaneously moving the adjacent ends of the first and second riveting ram assemblies together with sufficient force to upset the slug rivet, the adjacent end of the first riveting ram assembly being moved an amount equal to the movement of the adjacent end of the second riveting ram plus an amount equal to the frame deflection of the first frame portion so that the workpieces are not substantially moved during the riveting.

3. The method as set forth in claim 2 further comprising the additional step of permitting the first frame portion to move to its normal position from its deflected position after the slug rivet has been upset to progressively decrease the force applied to the associated end of the slug rivet while simultaneously progressively decreasing the force applied to the other end of the slug rivet.

4. A method for riveting two or more side-by-side workpieces together, the workpieces being provided with aligned apertures in which a slug rivet has been received; said method comprising the following steps:

providing a frame assembly having upper and lower portions and upper and lower movable riveting ram assemblies carried by the upper and lower frame portions, respectively, the upper frame portion deflecting during a rivet upsetting operation, and the upper frame portion being provided with an upward movement limiting stop movable between a first stop position and a second position;

positioning the upper riveting ram assembly against the upward movement limiting stop to establish an upper die cavity;

applying an upward force to move the lower riveting ram assembly upwardly towards the upper riveting ram assembly until both ends of the slug rivet are snugly engaged between adjacent ends of the upper and lower riveting ram assemblies;

applying a downward force to the upper riveting ram assembly until the downward force of the upper riveting ram assembly equals the upward force applied to the lower riveting ram assembly; and simultaneously moving the upper and lower riveting ram assemblies towards each other to simultaneously form upset heads on both ends of the slug rivet, the adjacent end of the upper riveting ram assembly being moved an amount equal to the movement of the adjacent end of the second riveting ram plus an amount equal to the deflection of the upper frame portion so that the workpieces are not substantially moved during riveting.

5. An apparatus for riveting two or more side-by-side workpieces together, the workpieces being provided with aligned apertures in which a slug rivet has been received; said apparatus comprising:

opposed upper and lower riveting ram assemblies aligned with the rivet and an upward movement limiting stop;

means for positioning the upper riveting ram assembly against the upward movement limiting stop to establish an upper die cavity;

means for applying an upward force to move the lower riveting ram assembly upwardly towards the upper riveting ram assembly until both ends of the slug rivet are snugly engaged between adjacent ends of the upper and lower riveting ram assemblies;

means for applying a downward force to the upper riveting ram assembly until the downward force of the upper riveting ram assembly equals the upward force applied to the lower riveting ram assembly; and means for simultaneously moving the upper and lower riveting ram assemblies towards each to simultaneously form upset heads on both ends of the rivet.

6. An apparatus for riveting two or more side-by-side workpieces together, the workpieces being provided with aligned apertures in which a slug rivet has been received; said apparatus comprising:

a frame assembly including upper and lower frame portions disposed to opposite sides of the side-by-side workpieces;

opposed upper and lower riveting ram assemblies aligned with the rivet, said upper and lower riveting ram assemblies being carried by said upper and lower frame portions, respectively;

an upward movement limiting stop movable between a first stop position and a second position where the stop does not limit movement, said stop being carried by said upper portion of the frame;

means to move the stop between its first and second positions;

fluid pressure means for moving the upper riveting ram assembly upwardly against the stop when the stop is in the first position to establish an upper die cavity;

means for applying an upward force to the lower riveting ram assembly to move the lower riveting ram assembly upwardly towards the upper riveting ram assembly until both ends of the slug rivet are snugly engaged between adjacent ends of the upper and lower riveting ram assemblies;

means for applying a further fluid force to force the upper riveting ram assembly downwardly until the downward force applied to the upper riveting ram assembly equals the upward force applied to the lower riveting ram assembly and which will permit the limiting stop to shift from its first position to its second position;

limit switch means contacted by the stop when it completes movement from its first position to its second position; and means for simultaneously moving the upper and lower riveting ram assemblies towards each other to simultaneously form upset heads on both ends of the rivet, said last mentioned means only being applied after the limit switch has been contacted.

7. An apparatus for riveting two or more side-by-side workpieces together, the workpieces being provided with aligned apertures in which a slug rivet has been received; said apparatus comprising:

a frame assembly having first and second frame portions;

first and second riveting ram assemblies aligned with the slug rivet and carried by the first and second frame portions, respectively, at least one of the frame portions deflecting during a riveting upsetting operation;

means to simultaneously move the adjacent ends of the first and second riveting ram assemblies together with sufficient force to upset the slug rivet; and means to move the adjacent end of the first riveting ram assembly during the rivet upsetting operation an amount equal to the deflection of the first frame portion so that the workpieces are not substantially moved during the riveting.

8. An appartus for riveting two or more side-by-side workpieces together, the workpieces being provided with aligned apertures in which a slug rivet has been received; said apparatus comprising:

a frame assembly having first and second frame portions disposed to opposite sides of the side-by-side workpieces, the first frame portion deflecting during a rivet upsetting operation;

first and second riveting ram assemblies aligned with the slug rivet and carried by the first and second frame portions, respectively, each of the riveting ram assemblies including a fluid cylinder assembly, each fluid cylinder assembly including a cylinder, piston, and a piston rod, the piston rod for the second cylinder assembly including a load cell;

means to move the second riveting ram assembly into engagement with the slug rivet to snugly engage the ends of the slug rivet between adjacent ends of the first and second riveting ram assemblies;

means to simultaneously introduce fluid under pressure behind the pistons of the cylinders of the first and second riveting ram assemblies to move the adjacent ends of the first and second riveting ram assemblies together at substantially equal rates with sufficient force to upset the slug rivet; and means to move the adjacent ends of the first riveting ram assembly an equal amount to the deflection of the first frame portion during the rivet upsetting operation so that the workpieces are not substantially moved during riveting, said last mentioned means including a frame compensation hydraulic booster cylinder assembly including a frame compensation hydraulic booster cylinder assembly including a booster cylinder, and booster piston disposed within the booster cylinder, servo valve means to introduce fluid into the booster cylinder to one side of the booster piston to cause fluid to be displayed from the other side of the booster cylinder to the cylinder of the ram fluid cylinder assembly associated with the first riveting ram, the servo valve being under the control of said load cell.

9. The apparatus as set forth in claim 7 further including means to permit the first frame portion to move to its normal position from its deflected position after the slug rivet has been upset to progressively decrease the force applied to the associated end of the slug rivet, and means to simultaneously progressively decrease the force applied to the other end of the slug rivet.

10. An apparatus for riveting two or more side-by-side workpieces together, the workpieces being provided with aligned apertures in which a slug rivet has been received; said apparatus comprising:

a frame assembly having upper and lower frame portions and upper and lower movable riveting ram assemblies carried by the upper and lower frame portions, respectively, the upper frame portion deflecting during a rivet upsetting operation, and the upper frame portion being additionally provided with an upward movement limiting stop movable between a first stop position and a second position;

means to position the upper riveting ram assembly against the upper movement limiting stop when the stop is in its first stop position to establish an upper die cavity;

means to apply an upward force to move the lower riveting ram assembly upwardly towards the upper riveting ram assembly until both ends of the slug rivet are snugly engaged between adjacent ends of the upper and lower riveting rams assemblies;

means to apply a downward force to the upper riveting ram assembly until the downward force of the upper riveting ram assembly equals the upward force applied to the lower riveting ram assembly;

means to subsequently simultaneously move the upper and lower riveting ram assemblies towards each other to simultaneously form upset heads on both ends of the slug rivet; and means to move the adjacent end of the upper riveting ram assembly downwardly during the rivet upsetting operation an amount equal to the deflection of the upper frame portion so that the workpieces are not substantially moved during riveting.

* * * * *

UNITED STATES PATENT AND TRADEMARK OFFICE

CERTIFICATE OF CORRECTION

PATENT NO. : 5,060,362

DATED : Oct. 29, 1991

INVENTOR(S) : James L. Birke, et al.

It is certified that error appears in the above-identified patent and that said Letters Patent is hereby corrected as shown below:

Claim 1, column 13, lines 3-10 should read as follows:

--applying a downward force to the upper riveting ram assembly after both ends of the slug rivet are snugly engaged until the downward force of the upper riveting ram assembly equals the upward force applied to the lower riveting ram assembly, without any deformation of the rivet occuring due to the equal forces; and then,--

Column 1, line 42 change "cylinder" to --cylinders--;
Column 1, line 44 change "cylinder" to --cylinders--.

Signed and Sealed this

Sixth Day of April, 1993

*Attest:*

STEPHEN G. KUNIN

*Attesting Officer*

*Acting Commissioner of Patents and Trademarks*